US005844157A

United States Patent [19]

Kasha

[11] Patent Number: 5,844,157

[45] Date of Patent: Dec. 1, 1998

[54] MULTIPLE ADJUSTING SNARE ASSEMBLY

[76] Inventor: Robert J. Kasha, 9246 Geyser Ave., Northridge, Calif. 91324

[21] Appl. No.: 588,104

[22] Filed: Jan. 18, 1996

[51] Int. Cl.[6] ..... G10D 13/00; G10D 13/02

[52] U.S. Cl. ..... 84/415; 84/411 R; 84/416

[58] Field of Search ..... 84/415, 416, 411 R, 84/417

[56] References Cited

U.S. PATENT DOCUMENTS

| | | | |
|---|---|---|---|
| 1,595,764 | 8/1926 | Elliott | 84/415 |
| 2,261,120 | 11/1941 | Ludwig et al. | 84/415 |
| 4,018,130 | 4/1977 | Gariepy, Sr. | 84/415 |
| 4,018,138 | 4/1977 | Gariepy, Sr. | 84/415 |
| 4,138,920 | 2/1979 | Meador | 84/415 |
| 5,275,081 | 1/1994 | Freer | 84/415 |

*Primary Examiner*—Jonathan Wysocki
*Assistant Examiner*—Marlon T. Fletcher
*Attorney, Agent, or Firm*—Roth & Goldman

[57] ABSTRACT

A snare assembly for use with a snare drum that provides for the precise fine tuning of a portion of helical wire snares. This snare assembly includes a fine tuning clasp unit comprising an angled stationary snare clasp threadingly engaged to a mobile snare clasp by a fine adjustment tension screw. Also provided are helical wire snares which are soldered to the angled stationary clasp and to the mobile snare clasp and then spanned a distance defining a snare surface and soldered to an angled snare clasp. The snare surface slightly bows in the direction towards the snare head of a drum when the snare assembly is activated by a throw off lever as a result of the use of the two angled snare clasps. Also provided is a leveling bar secured to the angled stationary clasp to maintain a constant uniform downward pressure on the helical wire snares soldered to the mobile snare clasp.

6 Claims, 3 Drawing Sheets

MULTIPLE ADJUSTING SNARE ASSEMBLY

BACKGROUND

1. Field of Invention

This invention relates to snare drums, specifically to an improved snare assembly which produces the snare sound. More specifically, to a snare drum assembly that enables the fine tuning of a set of snares without affecting the remaining snares.

2. Description of Prior Art

The standard modern snare drum generally comprises two drum heads stretched across opposite sides of a drum shell and a series of snares situated on the bottom head. The snares are attached to a strainer clamp mounted on one side of the drum shell and run across the bottom head to another strainer clamp mounted on the opposite side of the shell. One of the strainers is coupled to a throw off lever which engages and disengages the snares from coming into contact with the bottom head.

Various inventions of the past have sought to improve the adjustability of the snare drum as well as to improve its distinctive sound. One such early invention was U.S. Pat. No. 1,595,764 granted to J. M. Elliott on Aug. 10, 1926. The Elliott drum snare tightener demonstrated three different ways to adjust the tension of gut snares. Elliott provided for a throw off lever to engage and disengage the snares from contacting the bottom head, an adjusting knob which tightened and loosened the tension of all of the snares as a unit, and a set of screws to adjust the tension of each individual snare. The Elliott invention was intended to be used with snares made out of gut or some similar cable as was the common practice at the time. But with the advent of the use of helical wire snares instead of gut snares, the Elliott invention was no longer an essential piece of equipment. The Elliott invention could not be used with helical wire snares. This particular invention called for the snares to be bent over the edge of the snare head. If helical wire snares were bent over the snare head, the wires would rip and tear the snare head with each strike of the batter head.

With helical wire snares becoming more popular, an interesting invention was patented to W. F. Ludwig et al. on Nov. 4, 1941, U.S. Pat. No. 2,261,120. The Ludwig snare drum provided for two separate sets of snares to be situated on the bottom head. One set of snares could be the more traditional gut snares and the other set of snares could be the newer helical wire snares. It was made possible to activate the gut snares alone, the wire snares alone, or the two different sets of snares together at the same time. Snare drums with two independent sets of snares are still available at the present time, even though the vast majority of the snare drum market now uses only helical wire snares. These drums are now used to provide the use of two independent sets of helical wire snares at the same time. These drums do provide quality snare tone, but are extremely expensive in comparison to snare drums providing the use of only one set of wire snares.

By the time rock and roll music had achieved popularity, helical wire snares had become the industry standard. Gut snares and the like are at the present time only used on occasion and primarily in the limited capacity for use on marching band snare drums.

Several patents have attempted to improve upon the tonal quality of the now widely used helical wire snares. U.S. Pat. No. 4,018,130 granted to Gariepy, Sr. on Apr. 19, 1977 was a snare assembly that attempted to eliminate the undesirable distortion of the snare sound known as "choking." "Choking" is caused by the snare wires not being evenly tensioned across the entirety of the snare head, thus creating uneven tension gaps in the snares which are referred to as "dead spots." Gariepy and similar snare assemblies attempted to overcome these "dead spots" and the resulting "choking" effect but created a new problem that had to be overcome. The metal frames of these assemblies audibly vibrated after each hit of the batter head. This unwanted noise became known as "buzzing."

Several inventions were then designed to reduce this unwanted "buzzing" noise. One such invention was U.S. Pat. No. 4,138,920 granted to Meador on Feb. 13, 1979. This particular snare drum attachment provided for two bridges to press the wire snares into contact with the snare head in order to dampen the vibration carried from the snares to the metal attachment. This had limited success, however, because the cushioning bridges also dampened the desired resonating quality of the wire snares.

Because of the problems associated with these past snare drum attachments, the industry standard has remained virtually unchanged for very many years. The vast majority of the snare drum market uses the basic snare assembly consisting of a group of helical wire snares soldered to two metal snare clasps which are then attached by various means to strainers on opposite sides of the drum shell with one strainer coupled to a throw off lever.

A more recent invention, U.S. Pat. No. 5,275,081 granted to Freer on Jan. 4, 1994, provided for a snare clamp for a drum which allowed for adjustment of a portion of snares without affecting the adjustment of the remaining snares to achieve a wider and richer snare tone. But the Freer invention could not possibly be used in conjunction with the now standard helical wires, because the clamping mechanism calls for the snares to bend over the edge of the snare head. And as has been previously mentioned, if helical wire snares were used in this capacity they would rip and tear the snare head with every hit of the batter head. The Freer clamp was thus designed to be used for the marching band market and not for the larger modern rock and roll market. Furthermore, the Freer clamp could not provide for an easy means of fine tuning the snares to achieve the precise desired snare sound. Any tuning according to the Freer invention was a matter of guess work and trial and error at best. The throw off lever would first have to disengage all of the snares. Then a tertiary element would have to be loosened from the primary and secondary elements by unscrewing an alien bolt. Then a portion of the snares could be loosened or tightened by manually releasing or pulling respectively on the cords attached to the snares. The alien bolt would then be retightened while trying to hold the portion of snares in the desired position. The throw off lever would then be engaged again. The batter head would then be struck with a drumstick to see if the desired tone was achieved. If the snares were not tensioned according to the users preference, then the whole process would then have to be repeated.

OBJECTS AND ADVANTAGES

Accordingly, several objects and advantages of the present invention are:

a) to provide an adjustable snare assembly comprising helical wire snares with a portion of these snares being capable of being fine tuned which coincides with industry standards and expectations regarding general structure and layout;

b) to provide for a superior means of being able to easily fine tune a portion of permanently soldered helical wire snares while all of the snares remain engaged to come into contact with the entirety of the snare head, thus eliminating "dead spots" on the snare head;

c) to provide superior snare tone quality using helical wire snares by being able to eliminate undesirable noise distortions such as "choking" and "buzzing";

d) to provide a snare drum that produces great snare sound whether the batter head is hit hard to produce a loud sound or hit soft to produce a gentle sound;

e) to provide excellent snare tone without having to purchase an overly expensive drum possessing two separate snare assemblies;

f) to provide a snare assembly that ultimately produces quality snare sound even from low end or moderate snare drums.

List of Reference Numerals in Drawings

| | | | |
|---|---|---|---|
| 10 | snare drum | 12 | snare head |
| 14 | batter head (not shown) | 16 | drum shell |
| 18 | snare rim | 20 | batter rim |
| 22 | tension rods | 24 | lugs |
| 26 | tension rod nuts | 28 | strainer |
| 30 | helical wire snares | 32 | strainer receptacles |
| 34 | snare assembly | 36 | strainer cords (not shown) |
| 38 | snare assembly receptacles | 40 | strainer apertures |
| 42 | strainer straps | 44 | snare assembly apertures |
| 46 | throw off lever | 48 | tensioning adjustment knob |
| 50 | outer helical wire snares | 52 | angled snare clasp |
| 54 | angled stationary snare clasp | 56 | center helical wire snares |
| 58 | mobile snare clasp | 60 | mobile snare clasp tab |
| 62 | stationary snare clasp tab | 64 | fine adjustment tension screw |
| 66 | mobile tab aperture | 68 | anti-vibration nut |
| 70 | snare clasp stabilizing tabs | 72 | snare clasp stabilizing tracks |
| 74 | snare clasp leveling bar | 76 | angled snare clasp unit |

DETAILED DESCRIPTION OF THE DRAWINGS

Figure 1:
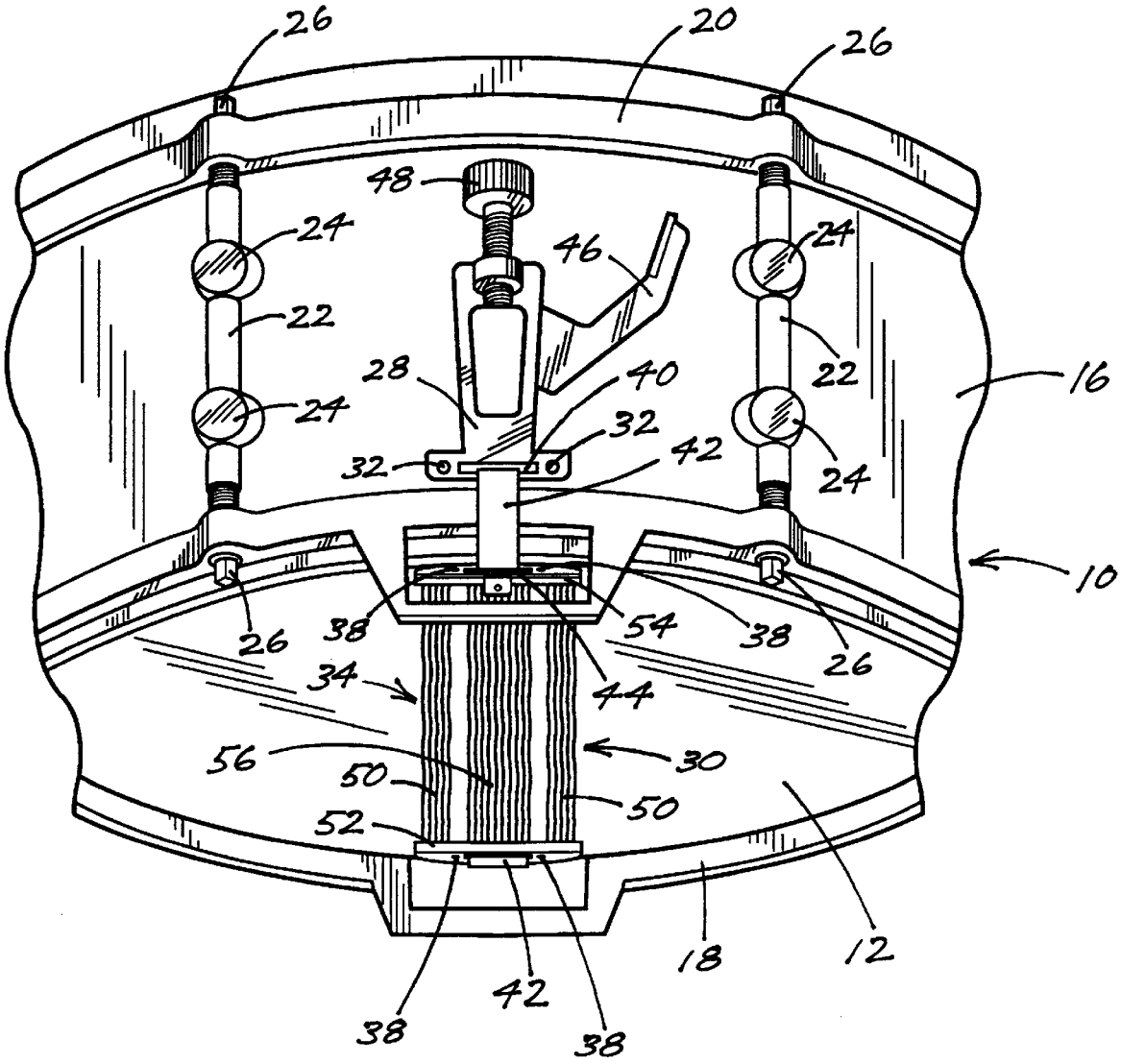
FIG. 1 is a perspective view of a portion of a snare drum fitted with the snare assembly of the present invention.

In reference to FIG. 1 a snare drum 10 includes a snare head 12 and a batter head 14 (not shown) connected to a drum shell 16. A snare rim 18 and a batter rim 20 surround shell 16. A set of tension rods 22 are held in place by passing through a series of lugs 24 which are attached to shell 16. Tension rods 22 are secured at opposite ends by passing through snare rim 18 and batter rim 20 and then threadingly engaged by a series of tension rod nuts 26. Snare drum 10 has a strainer 28 mounted to shell 16 to apply tension to a group of helical wire snares 30. Strainer 28 has a set of two strainer receptacles 32 to attach a snare assembly 34 to drum 10 by attaching a set of two strainer cords 36 (not shown) to a set of two snare assembly receptacles 38 and to strainer receptacles 32. Strainer 28 also has a strainer aperture 40 to attach snare assembly 34 to drum 10 by attaching a strainer strap 42 to a snare assembly aperture 44 and strainer aperture 40. Snare drum 10 has a throw off lever 46 coupled to strainer 28. A tensioning adjustment knob 48 is coupled to strainer 28.

Figure 2:
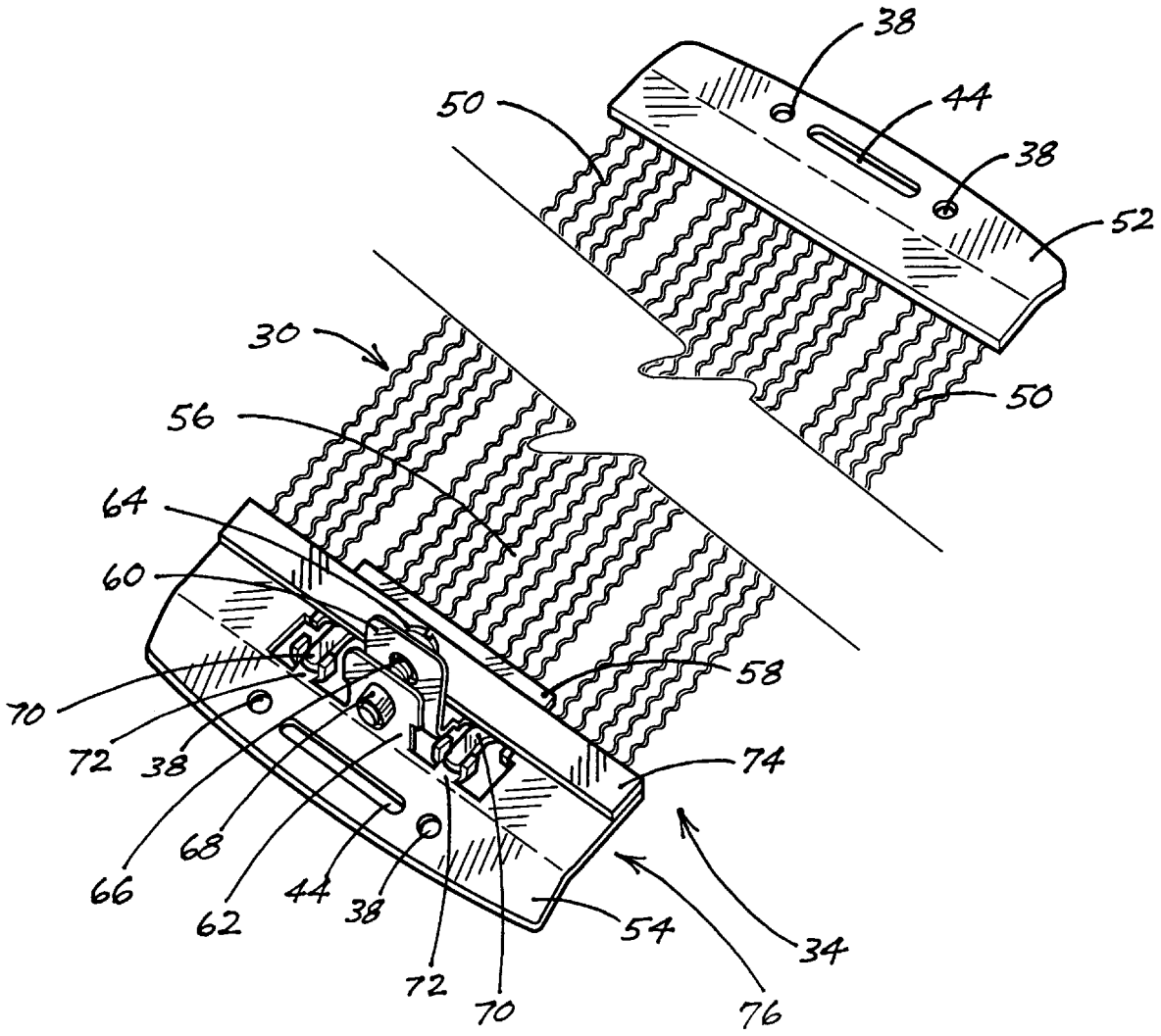
FIG. 2 is a fragmented top view of the snare drum assembly according to the present invention.
Figure 3:
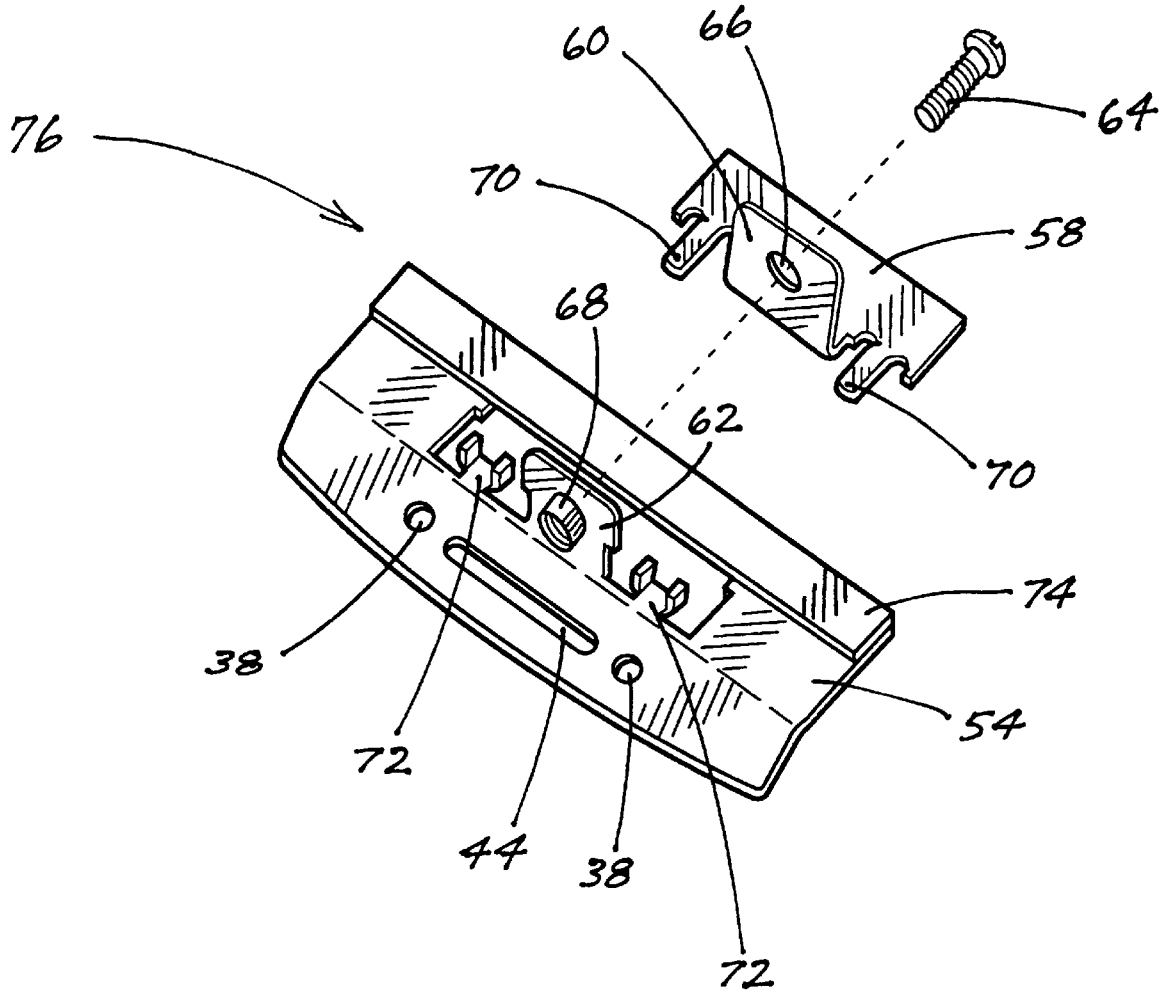
FIG. 3 is an exploded view of the snare drum assembly according to the present invention.

In reference to FIG. 2 and FIG. 3, the preferred embodiment of snare assembly 34 has a group of two sets of outer helical wire snares 50 permanently soldered to the underside of an angled snare clasp 52 and to the underside of an angled stationary snare clasp 54. Snare assembly 34 has a grouping of center helical wire snares 56 permanently soldered to the underside of angled snare clasp 52 and to the underside of a mobile snare clasp 58. Mobile snare clasp 58 has a mobile snare clasp tab 60 which abuts a stationary snare clasp tab 62 which is attached to stationary snare clasp 54. A fine adjustment tension screw 64 passes through a mobile tab aperture 66 and threadingly engages an anti-vibration nut 68 which is attached to stationary snare clasp tab 62. Mobile snare clasp 58 has a pair of snare clasp stabilizing tabs 70 which slide along a pair of snare clasp stabilizing tracks 72 which are attached to stationary snare clasp 54. A snare clasp leveling bar 74 is attached to stationary snare clasp 54. A snare clasp unit 76 is thus comprised of stationary snare clasp 54 adjustably coupled to snare clasp 58 by fine adjustment tension screw 64.

Operation—FIGS. 1, 2, 3

The operation of a preferred embodiment of the present invention is very similar to what is already standard in the snare drum industry. The snare assembly 34 is situated to contact the snare head 12 by using either strainer straps 42 or strainer cords 36 (not shown) depending on the users preference. Strainer cords 36 (not shown) could be attached to the snare assembly receptacles 38 and then attached to the strainer receptacles 32. The use of strainer straps 42 has been suggested in FIG. 1 and serve the same purpose as strainer cords 36 (not shown). Strainer straps 42 are attached to the snare assembly apertures 44 and then attached to the strainer apertures 40. The throw off lever 46 is then engaged in the standard manner to bring the helical wire snares 30 into firm contact with the snare head 12. The tension adjustment knob 48 is used to tighten or loosen the tension of all the snares 30 in relation to the snare head 12. After as much adjusting is deemed necessary by the user a second adjustment of the snares 30 can be made. By loosening and tightening the fine adjustment tension screw 64 the center helical wire snares 56 can be loosened and tightened without affecting the outer helical wire snares 50. When the fine adjustment tension screw 64 is threadingly tightened into the anti-vibration nut 68 the mobile snare clasp tab 60 pulls the mobile snare clasp 58 in the direction toward the angled stationary snare clasp 54. The snare clasp stabilizing tabs 70 slide along the snare clasp stabilizing tracks 72 as the mobile snare clasp 58 moves in the direction toward the angled stationary snare clasp 54. The snare clasp leveling bar 74 keeps a uniform downward pressure on the mobile snare clasp 58 at all times to ensure that all of the center helical wire snares 56 maintain an even pressure against the snare head 12. The operation is simply reversed to loosen the center wire snares 56 without affecting the tension of the outer wire snares 50. The fine adjustment tension screw 64 is threadingly loosened out of the anti-vibration nut 68 relaxing the mobile snare clasp tab 60 away from the stationary snare clasp tab 62. The mobile snare clasp 58 moves away from the stationary snare clasp 54 as the snare clasp stabilizing tabs 70 slide along the snare clasp stabilizing tracks 72 thus loosening the tension of the center helical wire snares 56 against the snare head 12. The center helical wire snares 56 now have the capacity to be finely tuned independent of the outer helical wire snares 50.

SUMMARY, RAMIFICATIONS, AND SCOPE

Accordingly, the reader will see that the snare assembly of the described invention greatly improves the adjustability of the standard helical wire snares. The present snare assembly replicates the industry standard snare assembly in design and application and still enables the user to finely tune a portion of the helical wire snares. The market does not have to become accustomed to any new and abstruse or hard to comprehend equipment.

The present snare assembly provides for several ways to maintain constant and even pressure of the snares against the entirety of the snare head. The outer helical wire snares are permanently welded to two angled snare clasps. When the throw off lever is engaged to bring all of the snares into contact with the snare head, the angled snare clasps create a slight bowing effect on the outer wire snares in the direction toward the snare head to ensure that these snares achieve constant pressure across the full surface of the snare head. The center wire snares are permanently welded to an angled snare clasp and to the flat mobile snare clasp. With the mobile snare clasp attached to the angled stationary clasp by the fine adjustment tension screw, the center snare wires also bow slightly toward the direction of the snare head. The snare clasp leveling bar ensures that the center snare wires maintain an even and uniform tension across the surface of the snare head. By keeping all of the snares in tight contact with the snare head, the present snare assembly eliminates so-called "dead spots" along the snare head.

The present snare assembly greatly reduces the possibility of "choking" of the snares because of the ability to precisely fine tune the center wire snares. The present snare assembly also does not create any unwanted "buzzing" associated with the metal framed snare assemblies of the prior art.

The present snare assembly provides for an active snare sound whether the batter head is hit at soft levels or at hard levels. The center wire snares can be tensioned looser than the outer snares to produce great snare sound at varying levels of pressure applied to the batter head. When the batter head is hit soft the looser center snares predominantly activate to produce an active snare sound. When the batter head is hit hard the tighter outer snares predominantly activate to produce an active snare sound.

The present snare assembly makes it no longer necessary to purchase an overly expensive snare drum containing two separate snare assemblies. Dual snare assembly drums are used at the present time utilizing two different sets of helical wire snares tightened at different degrees of tension in order to produce a good snare sound over a wide range of soft and hard hit levels. Given the present snare assembly, however, this same effect is now possible at a greatly reduced price.

The present snare assembly vastly improves the overall snare tone of moderate and low-end snare drums. By being able to fine tune a portion of the wire snares without affecting the other wire snares, an ordinarily moderate or poor sounding snare drum can be greatly improved.

Although the descriptions presented contain many details, these should not be construed as limiting the scope of the invention but as merely providing illustrations of some of the presently preferred embodiments of this invention.

Thus the scope of the invention should be determined by the appended claims and their legal equivalents, rather than by the examples given.

What I claim is:

1. A snare assembly for use with a snare drum comprising: a first stationary snare clasp; a second stationary snare clasp; a mobile snare clasp adjustably coupled to said first stationary snare clasp; attaching means to secure said stationary snare clasps to the drum; a plurality of helical wire snares extending in a substantially flat plane between said first stationary snare clasp and said second stationary snare clasp, said mobile snare clasp being adjustably connected to said first stationary snare clasp to permit relative motion therebetween in said substantially flat plane; and at least one group of commonly tensioned helical wire snares being attached to said mobile snare clasp and other commonly tensioned groups of said helical wire snares being attached to said first stationary snare clasp, said mobile snare clasp being connected to said first stationary snare clasp by a threaded connection which permits movement of said mobile snare clasp in said plane of said snares to adjust the tension of said one group of helical wire snares.

2. The snare assembly according to claim 1 wherein said first stationary snare clasp and said second stationary snare clasp each have a portion for attachment to a snare drum which is angled with respect to the plane of said snares for bowing said snares toward an associated drum head.

3. The snare assembly according to claim 1 wherein said first stationary snare clasp further includes a levelling bar which extends generally transversely to said helical wire snares in a plane parallel to the plane of said helical wire snares to confine movement of said mobile snare clasp in said plane of said helical wire snares.

4. The snare assembly according to claim 3, further comprising stabilizing tabs attached to said first stationary snare clasp and stabilizing tabs attached to said mobile snare clasp, said stabilizing tabs engaging each other to confine movement of said mobile snare clasp in tracks extending parallel to said helical wire snares during adjustment of the tension of said snares.

5. The snare assembly of claim 1, wherein said helical wire snares are permanently affixed to each of said snare clasps.

6. The snare assembly of claim 5, wherein said mobile snare clasp is attached to said first stationary snare clasp such that said commonly tensioned first group of helical wire snares affixed to said mobile snare clasp is positioned between and in the same plane as said other commonly tensioned groups of helical wire snares affixed to said first stationary snare clasp.

* * * * *